US007103984B2

(12) United States Patent
Kastberg

(10) Patent No.: US 7,103,984 B2
(45) Date of Patent: Sep. 12, 2006

(54) ANCHOR BOLT AND SETTING TEMPLATE

(76) Inventor: David J. Kastberg, P.O. Box 8992, Breckenridge, CO (US) 90869

( * ) Notice: Subject to any disclaimer, the term of this patent is extended or adjusted under 35 U.S.C. 154(b) by 0 days.

(21) Appl. No.: 10/787,811

(22) Filed: Feb. 26, 2004

(65) Prior Publication Data

US 2005/0188559 A1 Sep. 1, 2005

(51) Int. Cl.
*E02D 27/00* (2006.01)

(52) U.S. Cl. ..... 33/562; 33/518; 52/295

(58) Field of Classification Search ..... 411/107, 411/180; 33/562, 563, 613, 645, 1 G, 566, 33/518, 666; 52/295, 712, 98, 293.3; D10/62, D10/64; 269/904

See application file for complete search history.

(56) References Cited

U.S. PATENT DOCUMENTS

| | | | | | |
|---|---|---|---|---|---|
| 2,378,850 | A | * | 6/1945 | Hyre | 249/210 |
| 3,552,734 | A | * | 1/1971 | Severino et al. | 269/287 |
| 3,750,360 | A | * | 8/1973 | Kingston | 52/714 |
| 3,854,371 | A | * | 12/1974 | Lamothe | 411/337 |
| 3,960,356 | A | * | 6/1976 | Adams | 249/205 |
| 4,736,554 | A | | 4/1988 | Tyler | 52/105 |
| 4,932,818 | A | | 6/1990 | Garwood | 411/107 |
| 5,060,436 | A | * | 10/1991 | Delgado, Jr. | 52/295 |
| 5,146,720 | A | * | 9/1992 | Turner | 52/98 |
| 5,154,559 | A | | 10/1992 | Wagner | 411/107 |
| 5,240,224 | A | * | 8/1993 | Adams | 249/93 |
| 5,317,850 | A | | 6/1994 | Colonias et al. | |
| 5,332,346 | A | | 7/1994 | Shinjo | |
| 5,407,182 | A | * | 4/1995 | Hartley | 269/43 |
| 5,630,303 | A | * | 5/1997 | Devenish, III | 52/295 |
| 5,670,076 | A | | 9/1997 | Leek | |
| 5,787,598 | A | * | 8/1998 | Tillis et al. | 33/645 |
| 5,794,394 | A | | 8/1998 | Bill et al. | |
| 5,937,613 | A | * | 8/1999 | Vess, Sr. | 52/749.1 |
| 6,105,332 | A | * | 8/2000 | Boyadjian | 52/698 |
| 6,431,517 | B1 | | 8/2002 | Chapman | 249/93 |
| 6,643,945 | B1 | | 11/2003 | Starks | 33/566 |
| 2006/0016140 | A1 | * | 1/2006 | Smith | 52/295 |

FOREIGN PATENT DOCUMENTS

| | | | | |
|---|---|---|---|---|
| JP | 58041121 | A | * | 3/1983 |
| JP | 2001172984 | A | * | 6/2001 |
| JP | 2002356853 | A | * | 12/2002 |
| JP | 2005282154 | A | * | 10/2005 |
| JP | 2005330797 | A | * | 12/2005 |

* cited by examiner

*Primary Examiner*—R. Alexander Smith
(74) *Attorney, Agent, or Firm*—Levenfeld Pearlstein, LLC

(57) ABSTRACT

An anchor bolt setting template is used to position an anchor bolt in a wall for attachment of a first plate or a second plate to the wall. The first and second plates having different dimensions from each other. The template includes a rigid washer plate having first and second ends and defining a longitudinal axis extending between the first and second ends. An opening is formed in the washer plate lying along the longitudinal axis. The opening is non-equidistant between the first and second ends and defines a first distance between the opening and the first end and a second distance between the opening and the second end. The first distance is established to position the anchor bolt in the wall to properly position the first plate for attachment to the wall, and the second distance is established to position the anchor bolt in the wall to properly position the second plate for attachment to the wall. The template can include a sleeve frangibly connected to the plate for receiving the bolt. The template in combination with an anchor bolt is also disclosed.

15 Claims, 2 Drawing Sheets

ANCHOR BOLT AND SETTING TEMPLATE

BACKGROUND OF THE INVENTION

The present invention relates to an anchor bolt and bolt setting template. More specifically, the present invention relates to a template for an anchor bolt for setting the distance and depth of the bolt and a bolt for use therewith.

Anchor bolts are used in all manner of construction projects, commercial as well as residential. Anchor bolts are used to secure a structural element or member to concrete. Anchor bolts are of two types, namely those installed in concrete that has already cured (drilled and installed in a drilled hole) and those that are set into concrete while the concrete is still "wet".

Anchor bolts that are set into cured concrete are typically more costly both in material and labor than those that are set into "wet" concrete. The higher cost is due to the more complex nature of the bolt (e.g., split bolt sleeves) and the costs incurred in drilling a hole into the cured and set concrete. On the other hand, while bolts that are set into "wet" concrete are easier to install and less costly, there are difficulties with positioning these bolts.

For example, when an anchor bolt is used to install a sill plate to a footing, in order to properly position the sill plate (e.g., space the sill plate from the outside surface of the footing), it is necessary to determine the exact location on the sill plate for a hole location to match the hole in the plate. That is, since the anchor bolts may not be a consistent distance from the outside edge of surface of the footing, individual measurements must be made and transcribed to the sill plate to match the bolt locations.

In addition, in order to properly fasten the bolt to the sill plate, a predetermined amount of thread must extend up from the footing. That is the bolt must extend up from the footing a minimum amount so that the bolt can be threaded. Moreover, in order to assure a minimum tensile strength is met, the bolt must be set into the concrete a certain minimum distance.

Known setting devices for anchor bolts include a template having a threaded sleeve that extends upwardly from a plate that threads onto the end of the anchor bolt. The template includes graduated frangible, i.e., break-away elements to measure distance from an object, such as a wall edge. While such a device may function well, it is impractical in that it must be threaded onto the bolt and the entirety of the device removed from the bolt in order to make use of the bolt. Moreover, such a template, in its entirety, must be removed from the bolt to make use of the bolt.

Accordingly, there is a need for an anchor bolt template that is easy to use, and can be used with different size sill plates to establish a proper and correct distance between the bolt and an edge of the foundation wall into which it is installed. Desirably, such a template also provides for setting the proper depth of the bolt into the concrete. More desirably, such a template can be left in place, so that the sill plate is installed over the template.

BRIEF SUMMARY OF THE INVENTION

An anchor bolt setting template is used to position an anchor bolt in a wall for attachment of a first plate or a second plate to the wall. The first and second plates having different dimensions from each other. A present template is configured for use with dimensional 2×4 and ×6 lumber.

The template includes a rigid washer plate having first and second ends and defining a longitudinal axis extending between the first and second ends. An opening is formed in the washer plate lying along the longitudinal axis. The opening is non-equidistant between the first and second ends and defines a first distance between the opening and the first end and a second distance between the opening and the second end. The first distance is established to position the anchor bolt in the wall to properly position the first plate (e.g., a 2×4) for attachment to the wall, and the second distance is established to position the anchor bolt in the wall to properly position the second plate (e.g., a 2×6) for attachment to the wall.

Presently, the template is formed from a plastic material. In this manner, the template can be thin (and still be rigid) and can be left in place after it is used to set the bolt in place. The present template is configured for receipt of a ⅜ inch diameter anchor bolt.

For use with a dimensional 2×4 plate, the first distance is 1¾ inches and for use with a dimensional 2×6 the second distance is 2¾ inches. The template has a width of about 1½ inches.

Preferably, the template includes indicia for indicating the first and second distances; that is, the direction for use with a 2×4 plate and the direction for use with a 2×6 plate.

A combination anchor bolt and setting template includes a bolt having projections, preferably three projections, that extend from the bolt shank or shaft between the threaded end and the second end. The projections secure the bolt to the plate to properly position the depth of the bolt in the wall.

An alternate embodiment of the template includes a sleeve extending upwardly from the washer plate, overlying the opening. The sleeve has an open inner region for receiving the anchor bolt. The sleeve has stop means to prevent over-insertion of the anchor bolt.

The sleeve is removable from the washer plate to expose an end of the bolt disposed therein. In a preferred embodiment, template is formed from a plastic material and is formed as an integral element. A frangible region is formed at a juncture of the sleeve and the washer plate, such that the sleeve is separable from washer plate at the frangible region.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
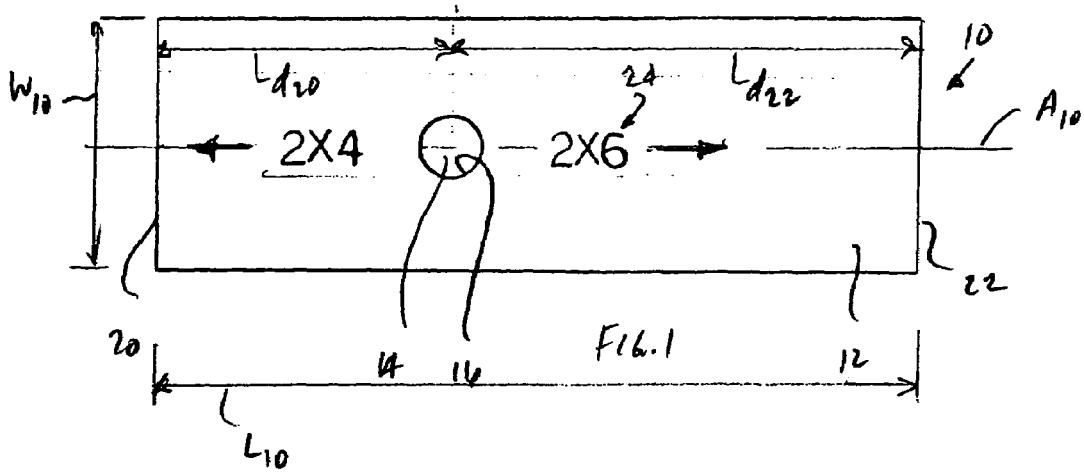
FIG. 1 is an top view of an anchor bolt template embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the drawings in particular to FIG. 1 there is shown an anchor bolt setting template 10 embodying the principles of the present invention. The template 10 is formed as a dimensioned rigid washer plate 12 having an opening 14 formed therein. The opening 14 is defined by an opening edge 16. Preferably, the opening 14 is formed in the transverse center of the template 10 lying along the plate longitudinal axis $A_{10}$ and is longitudinally off center as described below. The opening 14 can be formed having any of a variety of desired diameters to mate with anchor bolts 18 of predetermined, desired diameters.

Figure 3:
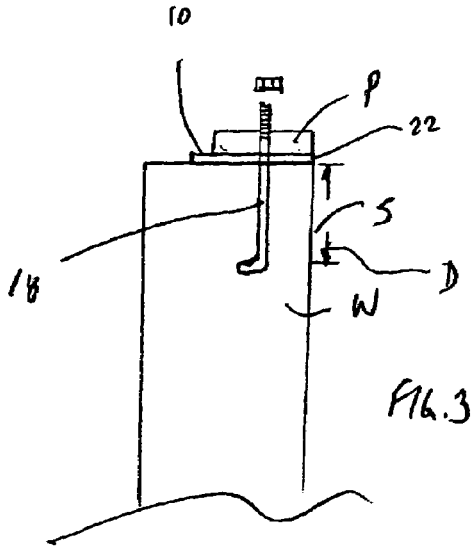
FIG. 3 is a side view of the anchor bolt and template positioned on a foundation wall with a sill plate installed on the wall, over the template.

Referring to FIG. 3, a present template 10 is configured for use in setting a sill plate P for a frame wall. The wall is fabricated over a concrete foundation wall W. Typically, the frame wall is fabricated using either 2 inch by 4 inch dimensional lumber or 2 inch by 6 inch dimensional lumber. It will be recognized that a dimensional 2×4 is actually 1½ inches by 3½ inches and a dimensional 2×6 is actually 1½ inches by 5½ inches.

To this end, the present template is formed having a length $L_{10}$ of about 4½ inches and a width $W_{10}$ of about 1½ inches. The width $W_{10}$ is, of course, not dimensionally consequential except for manufacturing and materials costs. The opening 14 is formed in the template 10 at a first distance $d_{20}$ of 1¾ inches from a first transverse edge 20 and at a second distance $d_{22}$ of 2¾ inches from a second, opposing transverse edge 22. A seen in FIG. 1, the template 10 can be marked with indicia 24 indicating the direction to the foundation wall W edge for proper spacing for the desired sill plate P size.

In this manner, as seen in FIG. 3, the template 10 can be positioned on the top of the wall W with the bolt 18 positioned in the opening 14, and with the first edge 20 flush with an outer surface S of the foundation wall W for setting a sill plate P for a 2×4 wall or with the template second edge 22 flush with the surface of the outer wall for setting a sill plate for a 2×6 wall. As such, the lateral position of the bolt 18 in the foundation wall W is properly set simply by aligning the first or second template edge 20, 22 with the foundation wall W outer surface S.

Figure 2:
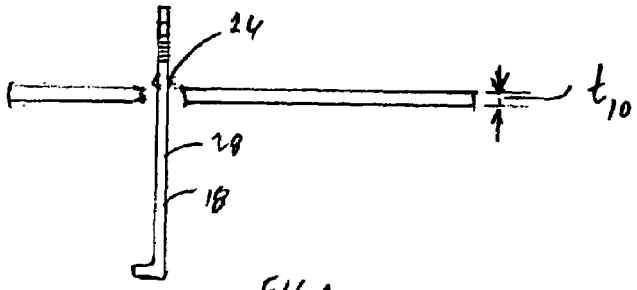
FIG. 2 is a side view the anchor bolt template with an anchor bolt positioned therein.

Referring now to FIG. 2, the anchor bolt 18 for use with the template 10 is shown. It will, however, be appreciated that any standard, properly sized anchor bolt can be used. The illustrated anchor bolt 18 is formed having a plurality of small projections 26 or knobs extending outwardly therefrom. On the illustrated bolt 18, three knobs 26 are formed equally circumferentially about the shaft 28 of the bolt 18. The knobs 26 are formed at a location along the length of the bolt 18 such that when the knobs 26 are engaged with the template opening edge 16, the bolt 18 is located on the template 10 for a proper bolt depth D or embedment in the concrete wall W.

Figure 4:
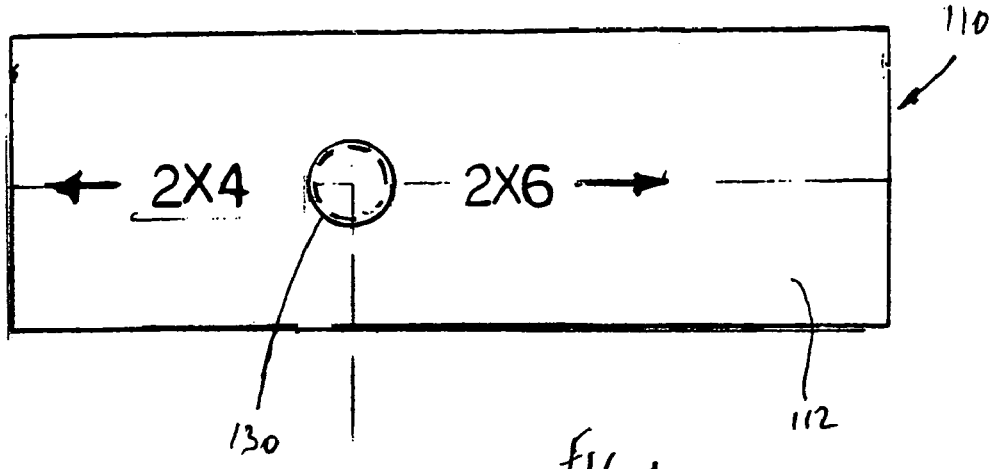
FIG. 4 is a top view of an alternate embodiment of the template having a removable sleeve attached to the top surface of the template.
Figure 5:
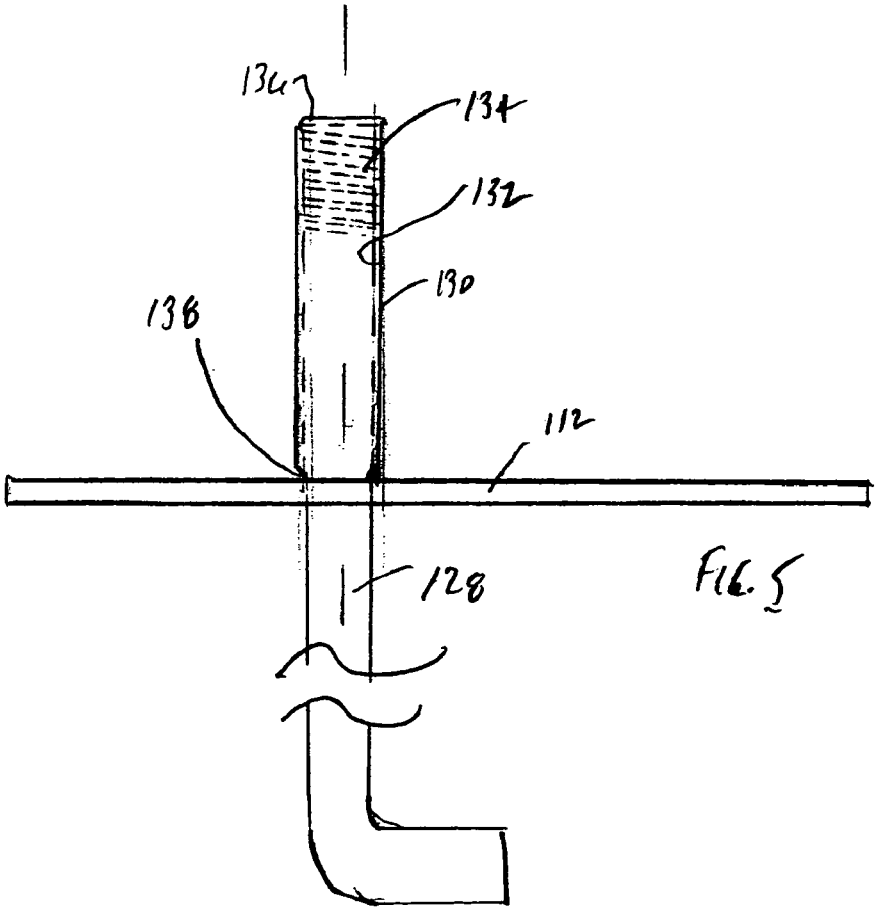
FIG. 5 is a side view of the template illustrated with a bolt threadedly engaged with the sleeve.

An alternate embodiment of the template 110 is illustrated in FIGS. 4 and 5. In this embodiment, the template plate 112 has a sleeve 130 extending upwardly from the plate 112. The sleeve 130 is hollow (thus defining an inner surface 132) and had a thread 134 formation on the upper portion of the sleeve 130 for threadedly engaging the bolt 128.

The top 136 of the sleeve 130 is closed or restricted to prevent over threading of the bolt 128. As will be appreciated by those skilled in the art, this embodiment of the template 110 can use a standard bolt 128 rather than one having knobs extending therefrom as shown in FIG. 2.

The sleeve 130 includes a weakened or frangible region 138 at the juncture of the sleeve 130 and the plate 112. In this manner, after the template 110 and bolt 128 are set in place on the concrete wall W, the sleeve 130 can be separated from the template 110 so that the bolt 128 is ready for use. It is contemplated that the sleeve 130 can simply be "pulled" off of the bolt 128 or threaded off of the bolt 128 once the bolt 128 is set, thus making use of the template 110 (and the bolt 128) quite easily accomplished.

The weakened or frangible region 138 can be made by reducing the thickness of the material at the juncture during forming (molding), or by cutting the material at the juncture following molding of the template 110. It is, however, contemplated although not necessary that the sleeve 130 and plate 112 be formed as an integral (e.g., single piece molded) unit.

A present template 10 is formed from a polymeric material, such a high density polyethylene or the like. It will be appreciated that the template 10 can be formed from relatively expensive materials and in such a manner that manufacturing is readily and inexpensively carried out. In that the template 10 is relatively rigid it can be made thin, having a thickness $t_{10}$ of about ⅛ inch, again, maintaining the cost low. Thus, the template 10 can be left in place on the foundation wall W after the bolt 18 is set, without adversely affecting the structural integrity of the frame wall.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An anchor bolt and setting template for use in positioning the anchor bolt in a wall for attachment of a first plate or a second plate to a wall, the first and second plates having different dimensions from each other, the anchor bolt and setting template comprising:

an anchor bolt having a diameter, the anchor bolt having a first threaded end and second end for setting the wall, the anchor bolt having at least one projection extending therefrom between the threaded end and the second end;

a rigid washer plate having first and second ends and defining a longitudinal axis extending between the first and second ends; and an opening formed in the washer plate lying along the longitudinal axis, the opening defined by an edge, the opening being non-equidistant between the first and second ends and defining a first distance between the opening and the first end and a second distance between the opening and the second end, the opening configured for receipt of the anchor bolt, wherein said at least one projection engages the edge of the opening to secure the plate and bolt to one another, wherein the first distance is established to position the anchor bolt in the wall to properly position the first plate For attachment to the wall, and wherein the second distance is established to position the anchor bolt in the wall to properly position the second plate for attachment to the wall, and wherein the bolt, secure to the plate opening by the projections properly positions the bolt at a predetermined depth in the wall.

2. The anchor bolt and setting template in accordance with claim 1 wherein the template is formed from a plastic material.

3. The anchor bolt and setting template in accordance with claim 1 wherein the anchor bolt has a ⅜ inch diameter.

4. The anchor bolt and setting template in accordance with claim 1 wherein the first distance is dimensioned for use with a dimensional 2×4 plate.

5. The anchor bolt and setting template in accordance with claim 4 wherein the second distance is dimensioned for use with a dimensional 2×6 plate.

6. The anchor bolt and setting template in accordance with claim 5 wherein the template has a width of about 1½ inches.

7. The anchor bolt and setting template in accordance with claim 5 including indicia for indicating a direction for use with the 2×4 plate and for indicating a direction for use with the 2×6 plate.

8. The anchor bolt and setting template in accordance with claim 1 wherein the second distance is dimensioned for use with a dimensional 2×6 plate.

9. The anchor bolt and setting template in accordance with claim 1 including indicia for indicating the first and second distances.

10. The anchor bolt and setting template in accordance with claim 1 wherein said at least one projection comprises three projections.

11. An anchor bolt setting template for use in positioning an anchor bolt in a wall for attachment of a first plate or a second plate to a wall, the first and second plates having different dimensions from each other, the template comprising:

a rigid washer plate having first and second ends and defining a longitudinal axis extending between the first and second ends;

an opening formed in the washer plate lying along the longitudinal axis, the opening being non-equidistant between the first and second ends and defining a first distance between the opening and the first end and a second distance between the opening and the second end; and a sleeve extending upwardly from the washer plate, overlying the opening, the sleeve having an open inner region for receiving the anchor bolt, the sleeve having stop means to prevent over-insertion of the anchor bolt, the sleeve being removable from the washer plate to expose an end of the bolt disposed therein, the template is formed as an integral element with the sleeve and includes a frangible region at a juncture of the sleeve and the washer plate, the sleeve being separable from the washer plate at the frangible region;

wherein the first distance is established to position the anchor bolt in the wall to properly position the first plate for attachment to the wall, and wherein the second distance is established to position the anchor bolt in the wall to properly position the second plate for attachment to the wall.

12. The anchor bolt setting template in accordance with claim 11 wherein the template is formed from a plastic material.

13. The anchor bolt setting template in accordance with claim 11 wherein first distance is dimensioned for use with a dimensional 2×4 plate.

14. The anchor bolt setting template in accordance with claim 13 wherein the second distance is dimensioned for use with a dimensional 2×6 plate.

15. The anchor bolt setting template in accordance with claim 11 wherein the second distance is dimensioned for use with a dimensional 2×6 plate.

* * * * *